US005313687A

United States Patent [19]

Schneider

[11] Patent Number: 5,313,687

[45] Date of Patent: May 24, 1994

[54] CEILING FAN BRUSH AND ADJUSTABLE ANGLE TUBE VACUUM CONNECTOR FOR SAME

[76] Inventor: Norman J. Schneider, 1120 S. King St., Honolulu, Hi. 96814

[21] Appl. No.: 929,336

[22] Filed: Aug. 14, 1992

[51] Int. Cl.[5] ..... A47L 9/06

[52] U.S. Cl. ..... 15/394; 15/398

[58] Field of Search ..... 15/398, 399, 400, 394

[56] References Cited

U.S. PATENT DOCUMENTS

| | | | |
|---|---|---|---|
| 4,685,170 | 8/1987 | Ahlf et al. | 15/398 X |
| 4,823,431 | 4/1989 | Carpenter | 15/398 X |
| 5,235,722 | 8/1993 | Harris et al. | 15/394 |

FOREIGN PATENT DOCUMENTS

| | | | |
|---|---|---|---|
| 516121 | 12/1952 | Belgium | 15/400 |
| 1093060 | 11/1960 | Fed. Rep. of Germany | 15/400 |

*Primary Examiner*—Chris K. Moore

*Attorney, Agent, or Firm*—Sughrue, Mion, Zinn, Macpeak & Seas

[57] ABSTRACT

An elongated body, has internally formed a plenum chamber opening to one face of the body. A pair of side brushes mounted on the face projected outwardly thereof and being spaced laterally from each other and extending over the major length of the body. A pair of longitudinally opposed end brushes spanned transversely across the body face from one side brush to the other project outwardly of the one face in the direction of the side brushes and form with the side brushes a vacuum chamber. The tips of the side brushes are formed of bristles of a length in excess of the length of bristles formed by the side brushes, and are engageable with laterally opposed longitudinally extending opposite side edges of planar ceiling fan blades. The side brushes are spaced from each other a distance generally equal to the lateral width of the ceiling fan blades. Locking plates fixed to the body project outwardly from opposite ends of the body longitudinally outside of the end brushes and in contact therewith such that the ceiling fan brush is effectively locked by the locking plates to the opposite side edges of the fan blade to facilitate dust removal from the surface of the fan blade enveloped by the ray of side brushes and end brushes while mechanically guiding the ceiling fan brush during travel longitudinally over the surface of the ceiling fan blade from one end to another.

14 Claims, 4 Drawing Sheets

FIG. 3
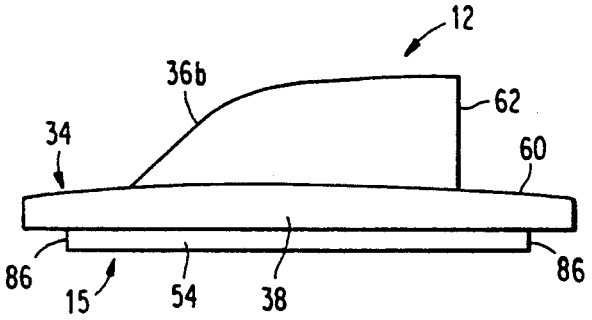
FIG. 4
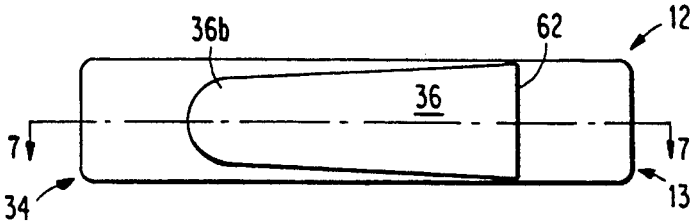
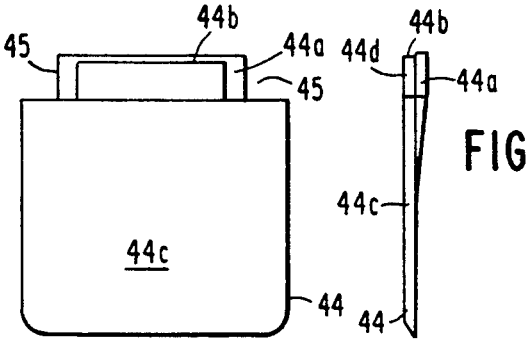
FIG. 5A
FIG. 5
FIG. 6
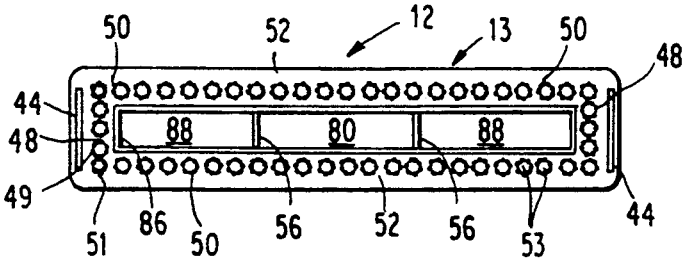
FIG. 7
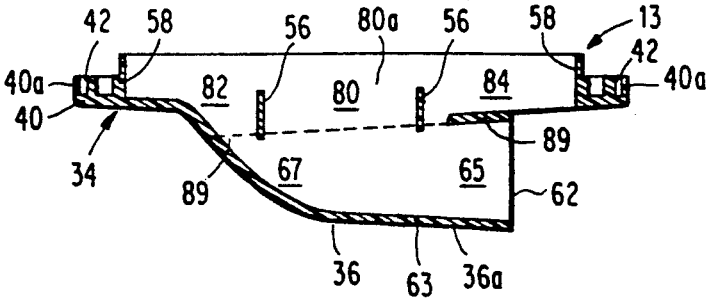

CEILING FAN BRUSH AND ADJUSTABLE ANGLE TUBE VACUUM CONNECTOR FOR SAME

FIELD OF THE INVENTION

This invention relates to a vacuum attachment tool, particularly useful in cleaning the blades of a ceiling fan, and more particularly to a vacuum brush head and an adjustable angle multiple tube vacuum connector for facilitating the angular adjustment of the vacuum brush head relative to a vacuum cleaner extension wand to which the vacuum brush head is telescopingly attached.

BACKGROUND OF THE INVENTION

Ceiling fan blades need to be cleaned regularly because dust and grime that attaches to the blades slows down the rotation of the fan blades and may cause the fan to break down prematurely. Ceiling fan blades have proven to be difficult to clean. Typically, a person is required to stand on a chair or a ladder to reach the fan. Since the fan blades rotate easily, the person cleaning the fan blades must use one hand to hold a given fan blade, while the other hand attempts to clean the fan blade with a cloth rag or the like. The person cannot be immediately under the fan while the blades are being cleaned, because the resultant, loosened dust falls directly into the face and hair of that person.

It is therefore a primary object of the invention to provide an improved ceiling fan brush, which may be readily attached to any vacuum cleaner via a vacuum cleaner hose or a vacuum cleaner extension wand, which may be readily coupled to the extension wand and removed therefrom, which may be positioned at different angular positions relative to the axis of the wand to facilitate cleaning of the respective top and bottom surfaces of the ceiling fan blades, which locks to the edges of the blade, which collects the loosened dust, which prevents the loosened dust from falling downwardly from the blade during cleaning, and whose vacuum brush head may be locked in different angular positions relative to an extension wand to which it is attached.

It is a further object of this invention to provide an adjustable angle tube vacuum connector which has particular application to a ceiling fan vacuum brush head, but may be employed with other vacuum cleaner attachments such as a round brush.

BRIEF DESCRIPTION OF THE DRAWINGS

FIG. 3 is a side elevational view of a portion of the brush head of FIGS. 1 and 2.

FIG. 4 is a top plan view of the portion of the brush head of FIG. 3.

FIG. 5 is an elevational view of one of the fan blade edge locking blades of the brush head of FIGS. 3 and 4.

FIG. 5A is a side elevational view of the fan blade edge locking blade of FIG. 5.

FIG. 6 is a bottom plan view of the brush head of FIG. 3 with the brush surrounding the platform.

FIG. 7 is a longitudinal, vertical sectional view of the brush head of FIG. 4 taken about line 7—7.

SUMMARY OF THE INVENTION

Figure 1:
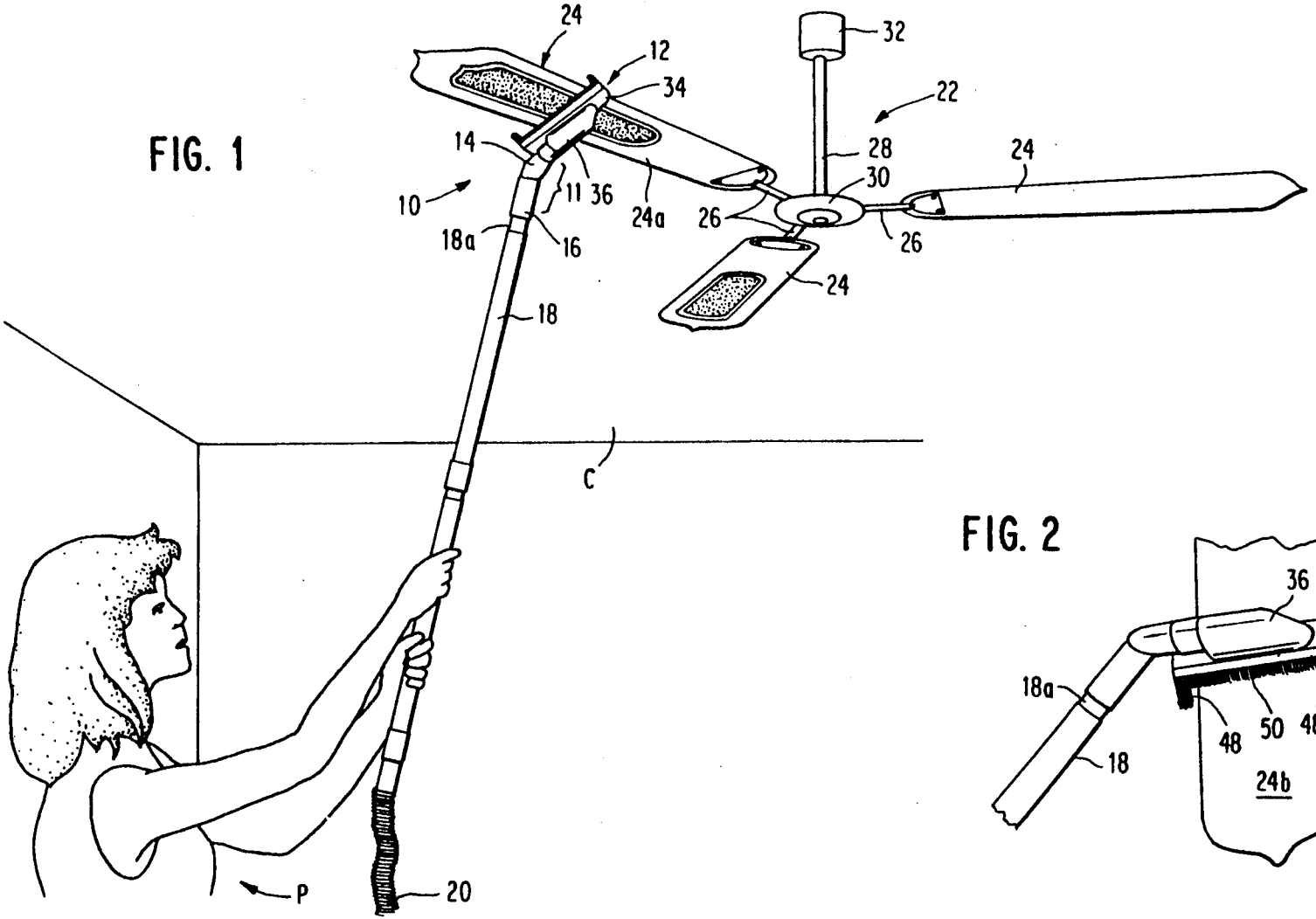
FIG. 1 is a perspective view of the ceiling fan brush and adjustable angle tube vacuum connector for the same forming a preferred embodiment of the invention as employed in cleaning the bottom surface of one fan blade of a ceiling fan to which the invention has particular utility.
Figure 2:
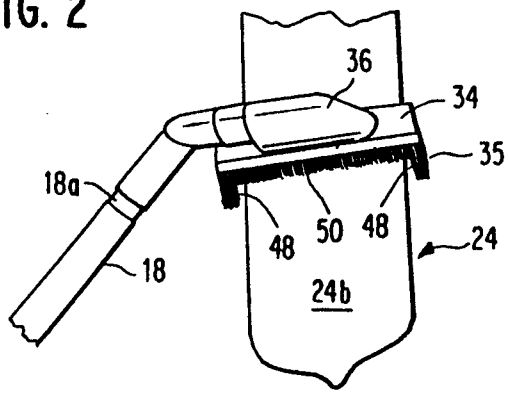
FIG. 2 is a perspective view of the apparatus of FIG. 1 with the vacuum brush head rotated 180° on the adjustable angle tube vacuum connector for cleaning of the top surface of a blade of the ceiling fan of FIG. 1.

Referring first to FIGS. 1 and 2, the ceiling fan brush and adjustable angle tube vacuum connector forming the two principal aspects of the present invention constitute an assembly indicated generally at 10, which is detachably coupled to one end of a conventional vacuum cleaner extension wand 18. The opposite end of the extension wand 18 is connected to a vacuum cleaner (not shown) via a flexible vacuum cleaner hose indicated generally at 20. The wand 18 may be held in both hands of a person P standing beneath and to one side of a ceiling fan indicated generally at 22. The fan 22 is suspended via a rotating shaft 28 from a ceiling fan motor 32 fixed to and depending from the ceiling C within a room housing the fan. The ceiling fan brush head indicated generally at 12 is connected via an adjustable angle tube vacuum connector indicated generally at 11, which in turn consists of a curved adjustable angle connector tube 14 frictionally connected to a straight adjustable angle connector tube 16. In conventional fashion, the leading end 18*a* of the extension wand is frictionally connected to the straight adjustable angle connector tube 16, while the end of the curved adjustable angle connector tube 14, remote from the straight connector tube 16, projects into a tubular receptacle 36 of the brush head 12. Such connections between wand 18, tubes 14, 16 of the adjustable angle tube vacuum connector 11 and the tubular receptacle 36 of the brush head 12 are by friction fit, and with one element being rotatable about its axis relative to the immediately adjacent element of that assembly. Such action permits the rotation of the end of the curved tube 14 relative to the tubular receptacle 36, with that end telescopingly received by the tubular receptacle 36 to properly orient the brush head 12 for cleaning the top surface as at 24*b*, FIG. 2, and from the orientation as shown in FIG. 1 for cleaning the bottom surface 24*a* of a fan blade 24. In that respect, the rotating shaft 28, which depends coaxially from the motor 32 fixed to the ceiling C, drives a circular disk head 30 from which radiate, by way of radial connecting rods 26, three fan blades 24. In this fan, the three blades are spaced equally at 120° from each other. In FIG. 1 the brush head 12 is shown as spaced some distance from the fan blade 24 and beneath the same prior to contact. In FIG. 2 the brush head is both above the top surface 24*b* of blade 24 and in contact therewith. The brush head 12, in addition to the tubular receptacle 36, is comprised principally of an elongated, generally rectangular plan form base 34 from the bottom of which projects downwardly, an inverted U-shaped transverse cross-sectional brush indicated generally at 35. Brush 35 is composed of longitudinally opposite end brushes 48 and laterally opposed side brushes 50, FIG. 2. Such arrangement of side brushes and end brushes may be more readily seen in FIG. 6, particularly as it applies to the application of vacuum pressure interiorly of the brush 35 on and about the top and bottom surfaces of the ceiling fan blades 24 which are to be cleaned.

Referring next to FIGS. 3–8 inclusive, the details of the brush head 12 may be readily seen and appreciated. Preferably, the brush head 12 is hollow and formed of a hollow molded plastic body 13 as a unitary structure, with the exception of the fan blade edge locking plates 44 and the longitudinally opposed, downwardly projecting end brushes 48 and the laterally opposed, downwardly projecting side brushes 50 which are interposed and extend continuously from one end brush 48 to the other. The molded plastic brush head body consists of a longitudinally directed, upwardly projecting tubular receptacle 36 from an integral underlying unitary base 34. Base 34 is comprised of a top surface 60 which tapers longitudinally from the center of the base downwardly slightly in both directions; laterally opposed sidewalls 38 and longitudinally opposed end walls 40. In FIGS. 3 and 4, the rear end of the body 13 is not shown, but is identical in all respects to that of the front end 40. Each end of body 13 includes a downwardly projecting, transversely extending fan blade edge locking plate 44. One plate 44 is shown in FIGS. 5 and 5A for snap fitting into a front rectangular recess at 40*a* and an adjacent transversely extending slot 42 within the molded plastic body 13. Identically, a second locking plate fits to a rear end of the body 13. The bottom wall 52 of the base 34 is stepped, as may be seen from FIGS. 6, 7 and 8 to form a bristle backing platform indicated generally at 15, that platform being of elongated rectangular form and extending over the major length of the base 34 and projecting downwardly from base bottom wall 52.

The tubular receptacle includes, FIG. 3, at a forward end adjacent a front circular opening 62, a circular ring portion 36*a* which has a conical interior surface 64 of slight taper so as to frictionally receive a matching conical external surface of the leading end 13*a* of curved tube 14 of the adjustable angle tube vacuum connector 11. This conical cavity or bore 65 opens rearwardly to a tubular cavity or chamber 67 of decreasing vertical height defined by the rear end 36*b* of the tubular receptacle 36 which merges into base 34 top wall 60. The interior of the base and the molded unitary structure includes a pair of vertical transverse walls 56 which act in conjunction with elongated, laterally spaced walls 54 to define a rectangular passage 80 which opens to vacuum chamber 81 partially created by the tufts 51 bristles 49 of the end brushes 48 and the side brushes 50, specifically the ends of the bristles 49 of those brushes which extend downwardly beyond a bottom wall 83 of the bristle backing platform. The vertical partitions 56 act in conjunction with the laterally outer sidewalls 38 of the base 34 to form separate interior chambers 82, 84 within the molded plastic body 13. As shown in FIG. 3, an opening 87 is formed within molded plastic top wall 60 of the base 34 to permit communication between chambers 67 and 84. Likewise, as shown in dotted lines to left, FIG. 3, a hole or opening 89 may be formed to communicate chamber 82 to the conical bore 65 of the tubular receptacle 36. Further, while in the illustrated embodiment the communication between the vacuum chamber 81 interiorly of the brush 35 is through a rectangular port 80*a* at the bottom of passage 80, communication may be effected by way of holes 88*a* indicated by dotted lines within the bottom wall 88 of the bristle backing platform 15 so that chambers 82, 84 act as plenum chambers to effect uniform vacuum pressure within the vacuum chamber 81 defined by the bristle backing platform 15 and the end brushes 48 and side brushes 50 and the workpiece being cleaned such as top and bottom surfaces 24*a*, 24*b* of the fan blades 24, FIG. 1.

In the illustrated embodiment, transverse rectangular elongated slots 42 are formed within the bottom wall 52 of base 34 at the front end 40 and the rear end of the brush head body 13. The elongated vertical slots 42 are inwardly from the body 13 end face 40 (and identically at the rear end of the body 13). Further, shorter lateral width and shorter vertical height openings at 40*a* are formed in both ends of body 13, opening to slot s 42. The laterally extending opening 40*a* acts in conjunction with the laterally larger length vertical groove 42 to form a T-shaped cavity for reception of the upper end of a fan blade edge locking plate 44, FIGS. 5, 5A. In that respect, the upper end of the rectangular plate 44 is recessed at 45 to form a vertical tab 44*d* having integrally a wider rear portion 44*a* which is also of a slightly larger vertical height than portion 44*d*. This forms a T-shaped insertion portion or tab of the plate 44 sized to and fitted into the vertical slot 42 and the transverse vertical recess 40 within the molded plastic base 34 of body 13. Since the fan blade edge locking plates 44 are also formed of molded plastic, they may have some slight flexure, however, they readily resist the flexion of the bristles 49 of the end brushes 48 which abut the inside surface of locking blades. The locking blades 44 thus restrain any tendency for the bristles of the end brushes 48 from deflecting outwardly away from the lateral edges of the fan blades 24 when the fan blades 24 are encompassed by the brush 35 and are subjected to vacuum pressure within the vacuum chamber 81 formed principally by the bristles of the side brushes 50 and the end brushes 48. In the illustrated embodiment, the extended lateral edges 44*e* of member 44*a* are captured within the lateral side portions of the vertical slots 42 at opposite ends of the base 34 which receives those fan blade edge locking plates 44. The fit is a frictional fit, however, if necessary the fan blade edge locking plates may be adhesively or otherwise coupled to the base 34 at the respective ends of the molded body 13.

Figure 8:
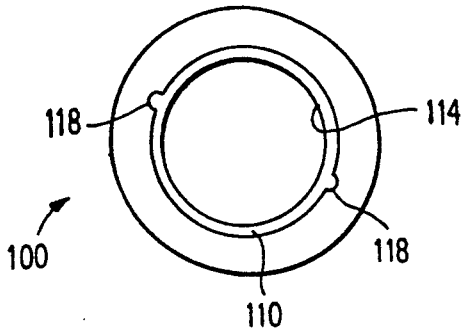
FIG. 8 is an end view of the brush head of FIG. 3.

The drawing FIGS. 6, 7 and 8 show the placement of individual tufts 51 of the bristles within respective molded in holes 53 within the base 34 bottom walls 52 along the complete length of the base 34 and about all four sides of the bristle backing platform 15. The bristle backing platform is defined by downwardly projecting lateral sidewalls 54, longitudinally opposed end walls 86, and vertical transverse walls 56. In the illustrated embodiment the vacuum port 80*a* opens only at the longitudinal center of the bristle backing platform to the vacuum chamber 81 over the span between the longitudinally spaced vertical walls 56 of this molded plastic structure. The chambers 82 and 84 are closed off at the bottom by thin plastic sheet material bottom walls 88. These bottom walls may be transparent or translucent to permit viewing of the interior of the respective chambers 82, 84 and may be adhesively sealed to the bottom surfaces of the bristle backing platform walls 54 and 86, as well as the lower ends of the transverse vertical walls 56 of this molded plastic structure. The formation of the brush end walls 48 and the brush side walls 50 to encompass and to principally define the vacuum chamber 81 by adhesively fixing the bristles in cylindrical tufts 51 within small diameter spaced circular holes at 53 over the complete bottom wall 52 is standard in mounting brush bristles to a supporting surface and constitutes conventional practice. The tufts 51 should be closely spaced to maintain sufficient vacuum pressure within the vacuum chamber 81 so that any dust particles dislodged by frictional contact of the bristles with the bottom and top surfaces of the fan blades 24 at **24*a*, 24*b* may flow into and be captured within the vacuum chamber 81 and readily removed through the passage 80 to the cavity 67 of the tubular receptacle 36 of brush head 12 and thence through the adjustable angle tube vacuum connector 11 to the vacuum cleaner (not shown) via extension wand 118 and hose 20, FIG. 1**.

While it is possible to directly couple the ceiling fan brush head 12 directly to the leading end **18*a* of the extension wand 118 without the adjustable angle tube vacuum connector 11, such connector permits the orientation of the brush head 12 to be readily adapted to the position and orientation of the fan blades 24 of ceiling fan 22**, or indeed a vast variety of other difficult to reach and fairly inaccessible articles requiring periodic cleaning.

Reference to FIGS. 9–13 shows the detailed makeup of the curved adjustable angle connector tube 14 and the straight adjustable angle connector tube 16 of assembly 11. In FIGS. and 10, it can be seen that the curved tube 14 is also formed of molded plastic, is of generally cylindrical form over the major portion of its length. Tube 14 is comprised of an elongated tubular body 100 of a predetermined interior diameter bore 102 which is uniform over most of its length from leading end **102*a* towards a trailing end 102*b*, however, the trailing end 102*b* curves to an angle of approximately 68° to the straight portion of tube 14. Further, the thickness of the cylindrical molded plastic body 100 varies from the leading end opening 104 in the direction of the trailing end opening 106, such that the outer periphery tapers slightly radially outwardly to form a conical outer peripheral surface 103, terminating in a radial shoulder 108. This permits a frictional fit of leading end 102*a* of the curved tube 14 to be effected with conical bore 63 of the tubular receptacle 36 of brush head 12. The rear end 102*b* of the curved molded plastic tube 14 has molded into the same a circular ring 110 which is of an external diameter considerably smaller than the external diameter of the rest of the tube 14 and which projects longitudinally beyond a radial end wall or flange 106 of tube 14. In the illustrated embodiment, the axis of the ring 112 as at C' is approximately 68° relative to the axis C of the straight leading end portion of the tubular molded plastic body 100. The axial length of the ring 112 is such that it is capable of supporting tube 16 and functions as a male connecting element by being telescopingly inserted within a corresponding ring or circular recess of the straight adjustable angle connector tube 16 to which it is directly frictionally coupled, FIGS. 1, 2. As will be appreciated, in the instant adjustable angle tube vacuum connector 11, it is preferred that the curved tube 14 and the straight tube 16 are not only frictionally coupled together, but that they are capable of rotation about a common axis. The integral ring member such as ring 110** rotates fully through 360° and permitting locking of the two tubes selectively, at 180° rotated positions.

Figure 9:
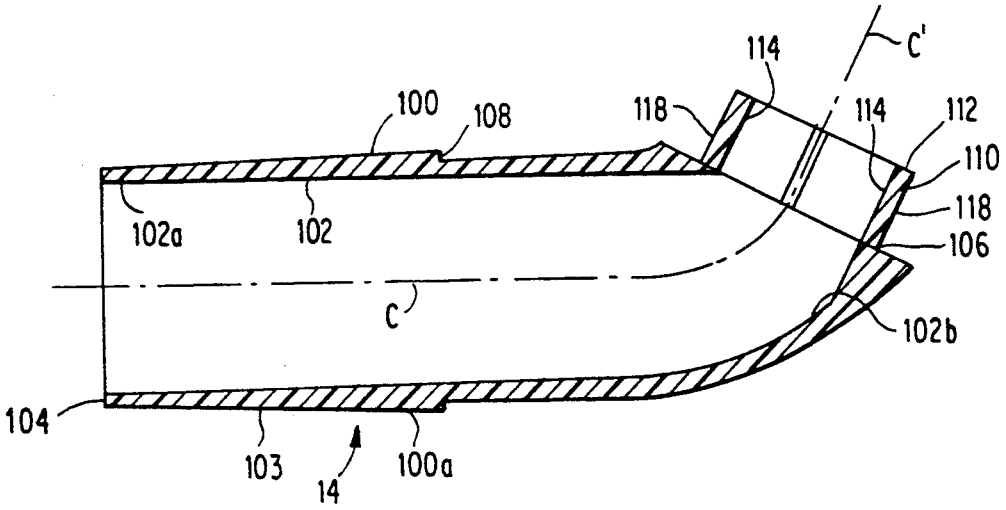
FIG. 9 is a longitudinal sectional view of the curved tube of the adjustable angle tube vacuum connector forming a part of the invention as a preferred embodiment.
Figure 10:
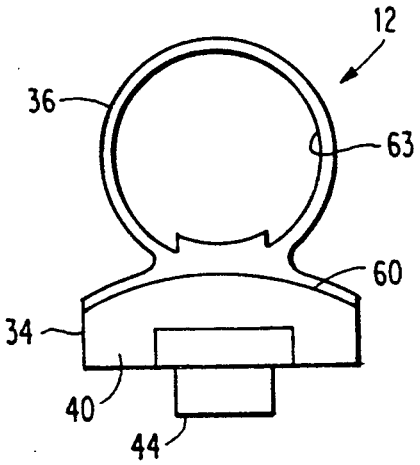
FIG. 10 is an end view of the curved angle adjustment tube of FIG. 9 illustrating the male connecting ring for insertion within a correspondingly sized circular recess within a straight tube forming the second component of the adjustable angle tube vacuum connector of FIG. 1.

In that respect, preferably for the male projection or ring 110, there are provided a pair of diametrically opposed, radially outwardly directed projections 118 on the outer periphery of ring 110 as seen in FIGS. 9 and 10. As will be appreciated hereinafter, those projecting ridges 118 are received within diametrically opposed grooves on the inside wall or bore of the female receptacle ring integrated to one end of the straight adjustable angle connector tube 16 of FIGS. 11–13 inclusive. The outer periphery 116 of the ring 110 of tube 14 is sized for a frictional fit within the interior bore of tube 16. The flanged surface 106 of the molded plastic tube 14 is at right angle to the axis of the ring 110, which projects axially outwardly from that flanged end of the curved tube 14.

Figure 11:
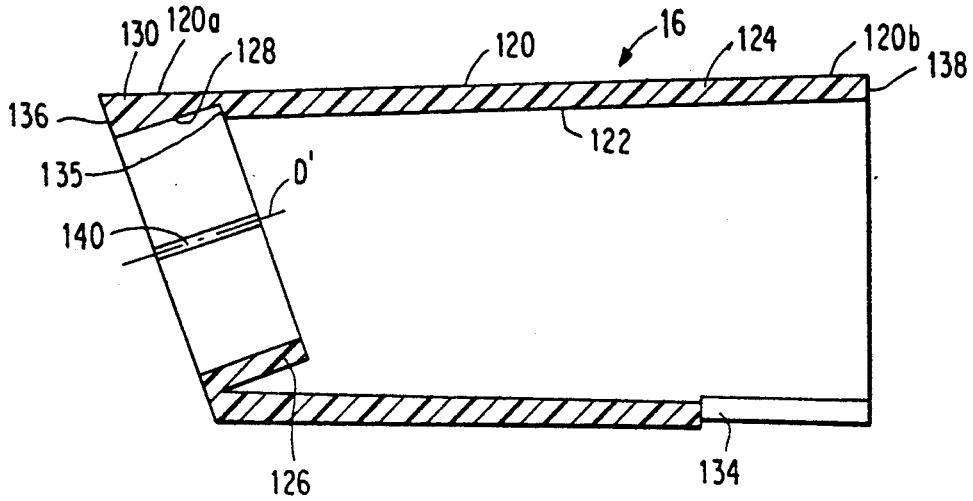
FIG. 11 is a longitudinal sectional view of the straight angle adjustment tube of the adjustable angle tube vacuum connector of FIG. 1.
Figure 12:
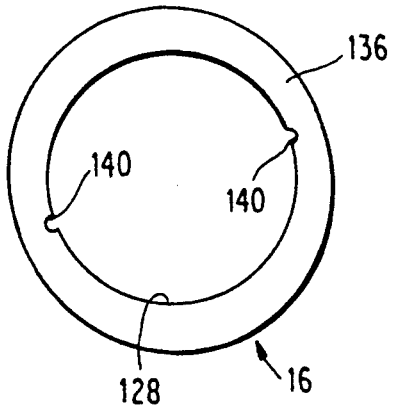
FIG. 12 is an end view of the straight angle adjustment tube of FIG. 11 illustrating the circular internal recess for receiving the male insertion ring of the curved angle adjustment tube of FIG. 9.
Figure 13:
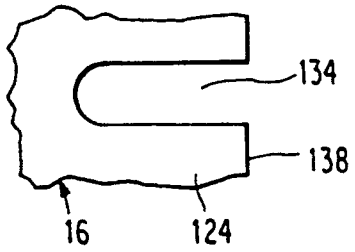
FIG. 13 is a plan view of a portion of the tube of FIG. 11 illustrating the elongated slot at the end of the tube of FIG. 11 opposite that of the circular recess.

Turning next to FIGS. 11–13 inclusive, the straight adjustable angle connector tube 16 is also formed of molded plastic and is constituted by a tapered tubular body 120 having a leading end **120*a* which is of smallest diameter, and a trailing end 120*b* of somewhat larger diameter, forming a conical interior bore 124. The outer periphery 124 is also conical and at the front end 120*a* matches the outer diameter 119 of the molded plastic tubular body 100 at flange 106 of the curved adjustable angle connector tube 14. In the molding of the tubular body 120, the leading end 120*a* of the molded tubular body is somewhat thicker and a circular ring 126 is integrally molded to that body. Ring 126 is at an oblique angle with respect to the axis of tube 16. In the illustrated embodiment, the axis D' of the ring 126 is approximately 19° to that the axis D of the straight tubular body 120. The integral ring 126 has a circular bore 128 of a diameter which is equal to or slightly larger than the outside diameter of male projecting ring 110 of tube 14 and frictionally receives the same to effect a telescoping coupling action as seen in FIGS. 1 and 2. Further, in the formation of ring 126, there is created a shoulder 135 over a short arcuate span which acts as a physical axial abutment for the projecting end face 112 of ring 110 of tube 14, FIG. 9. Since the vertical height of ring 110 is equal to the vertical depth of the interior bore 128 of ring 126 of tube 16, the flat front surface 136 of tube 16, which is oblique, contacts the flange 106 of tube 14, while the outer edge 112 of ring 110 seats against shoulder 135. There is relative rotation over a full 360° for the tubes 14, 16 when the male ring 110 is interfitted within the female bore 128 of tube 16. To effect locking at 180° rotation positions, there are provided a pair of diametrically opposite grooves 140, extending parallel to the axis D' of the ring 126 of tube 16 within the inner periphery 128 of ring and extending at an angle of 19° with respect to the longitudinal axis D of the molded plastic body 120, FIG. 11. Those grooves 140 are sized to match the ridges 118 projecting radially outwardly at diametrically opposite sides of the outer periphery ring 110 of tube 14. While 360° rotation of the male ring 110 internally within bore 128 of tube 16 is permitted, locking will occur at each of two 180° rotated positions, the result of which is to change the angle of inclination of the axis D of tube 16 relative to the axis C of tube 14 from one of 135° as illustrated in FIGS. 1 and 2, to an angular relationship of near 90°. Of course, this rotation between two locked positions has nothing to do with and is completely separate from the ability of leading end 102***a* of the curved adjustable angle connector tube 14 to be rotated and axially inserted and frictionally fitted internally of the tapered bore 63 of the tubular receptacle 36 of the brush head, which effects the change from bottom to top cleaning orientation of that head 12, as seen in contrasting FIGS. 1 and 2. In that case, there is no adjustment between tubes 14 and 16 of the assembly 11 and the angulation between the axes of tubes 14 and 16 in both Figures remain at approximately 135°.

Additionally, as seen in FIGS. 11 and 13, there is a narrow elongated slot 134 which extends inwardly from the downstream end face 138 of the tubular body 120 to give some flexibility to the tapered end of that tube so as to receive the female tapered end of the extension 118 to effect the frictional coupling, FIG. 1, between the extension 118 and ceiling fan brush 10 via the adjustable angle tube vacuum connector 11. As may be appreciated, various changes may be made to permit locking of the two tubes at various degrees of rotation other than at 180° diametrically opposite locations. Further, the oblique end faces of the respective mating portions of the two tubes 14, 16 may be readily changed, as well as the resulting angulation of the axes of the two ring structures integrated into the molded plastic components.

From the above description, it is apparent that the ceiling fan brush and adjustable angle tube vacuum connector for the same may be used with any vacuum cleaner to clean ceiling fan blades or other articles. Further, the ceiling fan brush head may be directly attached to the hose end of any vacuum cleaner, however, it works best when attached to the extension wand 18. By using the adjustable angle tube vacuum connector 11, the ceiling fan brush head 12 is preferably at the 135° locked position, this permits the user of the vacuum cleaner to stand at a desired position in relation to the ceiling fan in order to clean the fan blades 24 without being directly underneath the fan 22. After coupling, the ceiling fan brush head 12 to the extension wand 18 via the adjustable angle tube vacuum connector 11, the brush 35 is moved into face contact with either the top or bottom of a fan blade, where it locks onto the fan blade surface with the help of the fan blade edge locking plates 44, which prevent flexure of the end brushes 48 at opposite ends of the head 12. The fan blade edge locking plate and its adjacent end brushes 48 provide dual functions, they keep the fan blade 24 from moving while being cleaned and also permitting the brush 35 to clean the edges of the fan blade. There is no need to hold the fan blade 24 while vacuum cleaning the same. The dust, which is dislodged from the edges of the blades by the longer bristles 49 of the end brushes 48, is sucked from the bristles of end brushes 48 into the center part of the vacuum chamber 81, where the dust flows through passage 80 into the tubular receptacle 36 of that unit. The dust then passes in sequence through the adjustable angle tube vacuum connector 11, the wand 18 and the hose 20 to the vacuum cleaner.

To clean the other surface of the fan blade, the user P only needs to remove the adjustable angle tube vacuum connector 11 from the brush head 12 and rotate the brush head 180° or one half turn, then reattachment occurs by forcing the leading end 102*a* of the curved adjustable angle connector tube 14 into the tapered bore 63 of the tubular receptacle 36 to re-attach the ceiling fan brush head 12 and the head is in a proper position to clean the opposite face of the fan blade 24.

The adjustable angle tube vacuum connector is useful with other vacuum cleaner attachments such as a round tubular brush, which forms one component of almost all vacuum cleaner attachment sets. With the angle between tubes 14 and 16 settable at either 90° or 135° and held in these positions by the groove and ridge action, a 90° setting of the tube 14, 16 assembly permits the user to clean high ledges, tops of doors and door sills via a round brush, while the same round brush may be used with a 135° angle setting of the adjustable angle tube vacuum connector 11, facilitating the cleaning of the motor 32 housing for ceiling fan 22, FIG. 1.

The foregoing disclosure and description of the invention is illustrative and explanatory thereof and various changes in the size, shape and materials, as well as in the details of the illustrated apparatus, may be made within the scope of the appended claims without departing from the spirit from the invention.

What is claimed is:

1. A ceiling fan brush for vacuum cleaning of thin, elongated, planar ceiling fan blades having laterally opposed, longitudinally extending opposite side edges, said ceiling fan brush comprising: an elongated body, a plenum chamber within said body and opening to one face of said body, a pair of side brushes mounted on said one face and projecting outwardly thereof, spaced laterally from each other and extending over the major length of said body, a pair of longitudinally opposed end brushes, spanning transversely across the body on said one face and projecting outwardly of said one face in the same direction as said side brushes and forming with said side brushes a vacuum chamber with the tips of said side brushes in contact along each face of said thin elongated planar ceiling fan blade, the end brushes having bristles of a length in excess of the length of the bristles forming said side brushes and being spaced from each other a distance generally equal to the lateral width of the ceiling fan blades to thereby engage respective opposite side edges of said elongated planar ceiling fan blades, and means carried by said body and opening to said plenum chamber for coupling said plenum chamber to a source of vacuum pressure such that said ceiling fan brush, when moved longitudinally over the surface of the fan blade, dislodges accumulating dust from the surface of the fan blade and said dust is sucked into the plenum chamber under vacuum pressure for effectively removing the dust from the ceiling fan blades.

2. The ceiling fan brush as claimed in claim 1, further comprising locking plates fixed to said body and projecting outwardly therefrom at opposite ends of said body, positioned longitudinally outside of the end brushes and in contact therewith such that the ceiling fan brush is effectively locked by said locking plates to the opposite side edges of the fan blade to facilitate dust removal from the surface of the fan blade enveloped by the array of side brushes and end brushes and mechanically guiding the ceiling fan brush during travel longitudinally over the surface of the ceiling fan blade from one.

3. The ceiling fan brush as claimed in claim 2, wherein said hollow body includes a pair of transverse slots within opposite ends of said hollow body, and wherein said locking plates comprise thin planar members having ends insertably fitted within said slots for locking the locking plates to said hollow body.

4. The ceiling fan brush as claimed in claim 1, wherein said body comprises a hollow body, and the interior of the hollow body constitutes said plenum chamber.

5. The ceiling fan brush as claimed in claim 4, wherein said hollow body comprises a top surface and a bottom surface, and wherein said vacuum source connection means comprises a tubular receptacle fixed to the top surface and opening through said top surface to said plenum chamber.

6. The ceiling fan brush as claimed in claim 5, wherein said bottom surface of said hollow body is stepped to include a raised bristle backing platform of a lateral width equal to the spacing between the side brushes and of a longitudinal length generally equal to the distance between said end brushes, and said side brushes and end brushes are fixed to said bottom surface such that the bristles of said brushes project outwardly from the bottom surface and extend parallel to and generally in contact with the opposite sidewalls of said bristle backing platform.

7. The ceiling fan brush as claimed in claim 1, further comprising an adjustable angle tube vacuum connector detachably mounted to said tubular receptacle for direct coupling to a vacuum cleaner extension wand, and wherein said adjustable angle tube vacuum connector comprises end-to-end coupled curved adjustable angle first tube and a straight adjustable angle connector, second tube, and wherein said curved adjustable angle connector, first tube comprises a cylindrical straight portion at one end and an integral arcuately curved portion at an opposite end, wherein said arcuately curved portion terminates in an end face oblique to the axis of the cylindrical straight portion, and wherein said straight adjustable angle connector, second tube comprises a straight cylindrical tube having an end face at one end, oblique to the axis of said straight cylindrical tube, and wherein said ceiling fan brush further comprises a means for mechanically coupling said oblique end faces of said first tube and said second tube together in face-to-face relationship, with said first and second tubes being mutually rotatable relative to each other over at least 180° of rotation such that the angular relationships between the axes of the respective tubes vary during rotation of one with respect to the other.

8. The ceiling fan brush as claimed in claim 7, wherein one of said tubes at said oblique end face comprises a ring projecting axially longitudinally beyond said oblique end face perpendicular to the oblique end face, and said other tube at said oblique end face comprises a circular recess having a diameter generally equal to the outer diameter of said ring of said one tube such that the ring forms a male projection and said recess forms a female receptacle and said ring and said recess constitute said means for coupling of said first tube to said second tube.

9. The ceiling fan brush as claimed in claim 8, wherein said ring projects outwardly of the oblique end face of the first tube, and said circular recess is provided within the oblique end face of said second tube.

10. The ceiling fan brush as claimed in claim 7, wherein the curvature of said arcuately curved portion of said first tube relative to the straight portion of said first tube is of such extent, the angle of said oblique end face of the curved portion of the first tube relative to the axis of said oblique end face, and said angle of said oblique end face of said straight, second tube relative to the axis of the straight, second tube are such that the first and second tubes in rotating relative to each other through an arc of 180° effect an angular displacement between the axis of the straight portion of the curved, first tube and the axis of the straight, second tube from an acute angle to an obtuse angle.

11. The ceiling fan rush as claimed in claim 10, wherein said acute angle is slightly less than 90° and wherein said obtuse angle is approximately 135°.

12. The ceiling fan brush as claimed in claim 7, further comprising detent means carried by said first tube and said second tube proximate to said bevelled ends for locking said tubes at at least two circumferentially spaced positions.

13. The ceiling fan brush as claimed in claim 7, further comprising detent means for locking said tubes at two circumferentially spaced relatively rotated positions, and wherein said detent means comprises indentations on the periphery of one of said ring and said recess and a correspondingly configured projections on the periphery of said recess facing said ring and receiving the ring.

14. The ceiling fan brush as claimed in claim 13, wherein the indentations and projections are respectively grooves and ridges at at least diametrically opposite positions on said recess and ring respectively.

* * * * *